US009417033B2

(12) United States Patent
Wood et al.

(10) Patent No.: US 9,417,033 B2
(45) Date of Patent: Aug. 16, 2016

(54) ADJUSTABLE FIREARM STOCK ADAPTER ASSEMBLY

(71) Applicant: Fulcrum Concepts LLC

(72) Inventors: Stanley L. Wood, Yorktown, VA (US); Scott A. Richman, Hayes, VA (US); Michael S. Zinanni, Williamsburg, VA (US); Clay Eldridge, Lanexa, VA (US); Brian Byrd, Gloucester, VA (US); Douglas Maples, Parkton, NC (US)

(73) Assignee: FULCRUM CONCEPTS LLC, Mattaponi, VA (US)

( * ) Notice: Subject to any disclaimer, the term of this patent is extended or adjusted under 35 U.S.C. 154(b) by 0 days.

(21) Appl. No.: 14/837,586

(22) Filed: Aug. 27, 2015

(65) Prior Publication Data

US 2016/0061559 A1 Mar. 3, 2016

Related U.S. Application Data

(60) Provisional application No. 62/043,085, filed on Aug. 28, 2014.

(51) Int. Cl.
*F41C 23/14* (2006.01)
*F41C 23/20* (2006.01)

(52) U.S. Cl.
CPC *F41C 23/14* (2013.01); *F41C 23/20* (2013.01)

(58) Field of Classification Search
CPC ..... F41C 23/14; F41C 23/20; F41C 23/06; F41C 23/08; F41C 23/00
USPC ..... 42/73, 71.01, 72, 74
See application file for complete search history.

(56) References Cited

U.S. PATENT DOCUMENTS 1,088,362 A * 2/1914 Perkins ..... F41C 23/08 42/73
1,847,777 A * 3/1932 Morgan ..... F41C 23/08 42/73
2,066,218 A * 12/1936 Morgan ..... F41C 23/14 42/73
2,300,738 A * 11/1942 Ammann ..... F41C 23/08 42/73

(Continued)

FOREIGN PATENT DOCUMENTS

JP 2003-322497 11/2003

OTHER PUBLICATIONS

Recoil Butt Cable Adapter, http://stockpositioning.com/CIRSadj_LOP_recoil_butt_cable_adapter.htm, 3 pages.

(Continued)

*Primary Examiner* — Joshua Freeman
(74) *Attorney, Agent, or Firm* — Joshua B. Brady

(57) ABSTRACT

An adjustable butt stock adapter assembly may provide for vertical and rotational adjustment. A serrated plate may be positioned between an adapter with grooves for establishing a rotational position with the serrated plate, and a butt plate having serrations for establishing a vertical relationship with the serrated plate. The serrated plate may be operatively attached to a spring collar mounted in the adapter, such that pulling the serrated plate away from the collar and adapter overcomes the spring force and allows for adjustment of the rotational position. The butt plate may connect to the serrated plate through an engagement mechanism, such that disengaging the engagement mechanism allows for adjustment of the vertical position.

17 Claims, 16 Drawing Sheets

(56) References Cited

U.S. PATENT DOCUMENTS

| | | | | | |
|---|---|---|---|---|---|
| 2,455,438 | A * | 12/1948 | Oppold | F41C 23/06 | 42/73 |
| 5,009,021 | A | 4/1991 | Nelson | | |
| 5,392,553 | A * | 2/1995 | Carey | F41C 23/14 | 42/73 |
| 5,979,098 | A * | 11/1999 | Griggs | F41C 33/06 | 42/73 |
| 6,688,031 | B2 * | 2/2004 | Steele | F41C 23/14 | 42/71.01 |
| 6,889,461 | B2 * | 5/2005 | Vignaroli | F41C 23/08 | 42/73 |
| 7,124,529 | B1 * | 10/2006 | Havelka, Jr. | F41C 23/08 | 42/71.01 |
| 7,536,819 | B2 * | 5/2009 | Popikow | F41C 23/14 | 42/71.01 |
| 7,793,453 | B1 * | 9/2010 | Sewell, Jr. | F41C 23/04 | 42/73 |
| 7,930,849 | B2 | 4/2011 | Abraham et al. | | |
| 7,984,580 | B1 | 7/2011 | Giauque et al. | | |
| 8,720,099 | B1 * | 5/2014 | Sisk | F41C 23/14 | 42/73 |
| 8,763,296 | B1 | 7/2014 | Chvala | | |
| 8,776,423 | B2 * | 7/2014 | Paquette | F41C 23/14 | 42/73 |
| 8,844,185 | B2 | 9/2014 | Jarboe | | |
| 8,904,692 | B2 | 12/2014 | Ballard | | |
| 8,955,245 | B2 | 2/2015 | Chvala | | |
| 2003/0221352 | A1 * | 12/2003 | Steele | F41C 23/14 | 42/73 |
| 2011/0138668 | A1 | 6/2011 | Thomas | | |
| 2011/0173863 | A1 * | 7/2011 | Ingram | F41A 11/00 | 42/73 |
| 2013/0000175 | A1 * | 1/2013 | Quaedpeerds | F41C 23/20 | 42/73 |
| 2013/0097911 | A1 * | 4/2013 | Larue | F41C 23/04 | 42/73 |
| 2013/0174461 | A1 * | 7/2013 | Ballard | F41C 23/20 | 42/74 |
| 2014/0075815 | A1 * | 3/2014 | Jarboe | F41C 23/04 | 42/73 |
| 2014/0259848 | A1 * | 9/2014 | Chvala | F41C 23/14 | 42/73 |
| 2016/0010944 | A1 * | 1/2016 | Downey | F41C 23/06 | 42/74 |
| 2016/0061559 | A1 * | 3/2016 | Wood | F41C 23/14 | 42/73 |

OTHER PUBLICATIONS

Ajustable Match Rifle Stock, Http://www.tacstar.com/home/ar15stock.php, 1 page.

Battleline Industries SAPR Installation, Weapon Evolution, http://www.weaponevolution.com/forum/showthread.php?4922-Battleline, 9 pages.

* cited by examiner

ADJUSTABLE FIREARM STOCK ADAPTER ASSEMBLY

CROSS REFERENCE TO RELATED APPLICATIONS

This application claims the benefit of U.S. provisional patent application No. 62/043,085, filed Aug. 28, 2014, which is hereby incorporated in its entirety.

STATEMENT REGARDING GOVERNMENT SUPPORT

None.

FIELD

The present disclosure relates to an adjustable firearm stock adapter assembly.

BACKGROUND

Firearm stocks are typically fixed in a single position, and the end of the stock (normally a butt pad) is designed to fit into a user's shoulder pocket. Because the stock is fixed, the user must acclimate to the position of the stock. However, there can be significant variation in the shape and size of a user's shoulder. Such variation can result in discomfort, inaccurate, and unsafe shooting positions. Moreover, a user's clothing and load out can significantly vary from one situation to another. A user may wear body armor, a harness, and a backpack in one situation, but lightweight clothing in another situation. Such variation can also cause discomfort, inaccurate, and unsafe shooting positions.

A handful of contemporary adjustable stock assemblies are available, but they suffer from numerous limitations. Many contemporary adjustable stock assemblies require modification of an existing stock for attachment, making the addition of the adjustable stock a permanent modification. Although contemporary stock assemblies provide for adjusting an aspect of the stock about one or two axes, making the adjustment requires manipulating one or more unlocking one or more elements, and cannot be done without a special tool or under duress. As a result, the stock position cannot be easily adjusted under duress. Further, the common axes of adjustment—vertical position and rotational position—are often provided through separate mechanisms, further complicating the process of adjusting the stock to the desired position.

What is needed is a cost-effective ability for a firearm user to easily and conveniently adjust the position of the end of the stock, such as vertical, horizontal, and/or rotational position of the butt pad, to meet the user's specific needs.

BRIEF SUMMARY

This disclosure relates to an adjustable adapter assembly for a firearm, such as a rifle or a crossbow. The adjustable adapter assembly provides convenient and simple methods for a user to adjust the position of the end of a firearm stock, such as a butt pad, to suit a user's preferences and/or needs. The following description relates to various embodiments, and it should be understood that the arrangement or configuration of the embodiments may be modified without departing from the scope of this disclosure.

The adapter assembly includes an adapter for attachment to a stock and a butt plate, and features a mechanism that uses a serrated plate to provide rotational and vertical adjustment of a butt plate relative to an adapter. In the embodiments described herein, rotational adjustment may be achieved through splines formed or machined into one side of the serrated plate. The splines engage corresponding grooves formed or machined in a circular manner into a surface of an adapter that can be fashioned to attach the adapter assembly to a specific gun stock, including original equipment manufacturer stocks and after-market stocks. The serrated plate may also include a series of vertical and/or horizontal serrations formed or machined into another surface, such as the opposite side from the splines. Such serrations may mate with corresponding serrations formed or machined into a butt plate, thereby providing for vertical adjustment of the assembly. It should be appreciated that other embodiments may rearrange the location of grooves, splines, and serrations, without departing from the scope of this disclosure.

The mechanism may be held together with a number of conventional mechanisms, such as a screw or bolt that passes through the butt plate, the serrated plate, the adapter, and into a collar. Spring tension may be applied through a collar so that when a user pulls the butt plate away from the adapter, the serrated plate's splines disengage from the adapter's grooves until the desired rotational adjustment is made, and then the spring tension pulls the serrated plate's splines back into the adapter's grooves to hold the components in the selected position.

To make a vertical adjustment, a user may loosen the screw or bolt holding the mechanism together, which disengages the serrated plate and butt plate serrations. The vertical adjustment is made and the screw or bolt may be tightened to hold the butt plate in selected position. It should be understood that the location of the splines, grooves, and serrations may be varied between the components. Also, it should be understood that the mechanisms for applying tension, such as the tension spring and screw shown in the embodiment described below, may be modified or replaced with other structure that performs the function of selectively tensioning the various components.

DESCRIPTION

The following description is of the best currently contemplated mode of carrying out exemplary embodiments of the invention. The description is not to be taken in a limiting sense, and is made merely for the purpose of illustrating the general principles of the invention.

Figure 1:
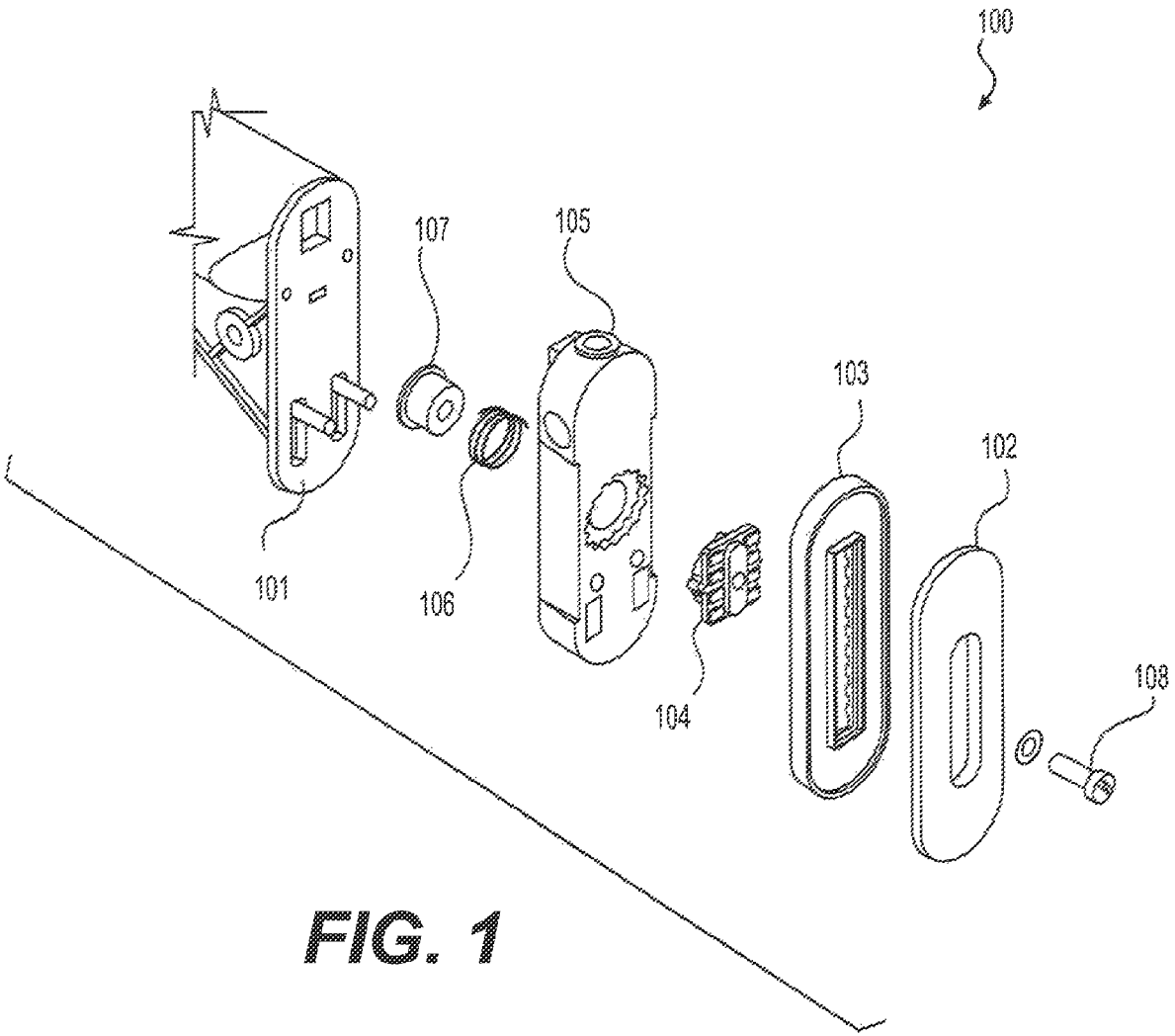
FIG. 1 is a diagram of the components of an embodiment of an adjustable firearm stock adapter assembly for mating with a firearm stock.

FIG. 1 is a diagram of the components of an embodiment of an adjustable firearm stock adapter assembly for mating with a firearm stock, such as a rifle, shotgun, or crossbow. In this embodiment, the assembly 100 comprises butt pad 102, butt plate 103, serrated plate 104, adapter 105, compression spring 106, collar 107, and engagement mechanism 108 (in this embodiment, a screw). Assembly 100 may be mounted on stock 101 as described herein.

Figure 2:
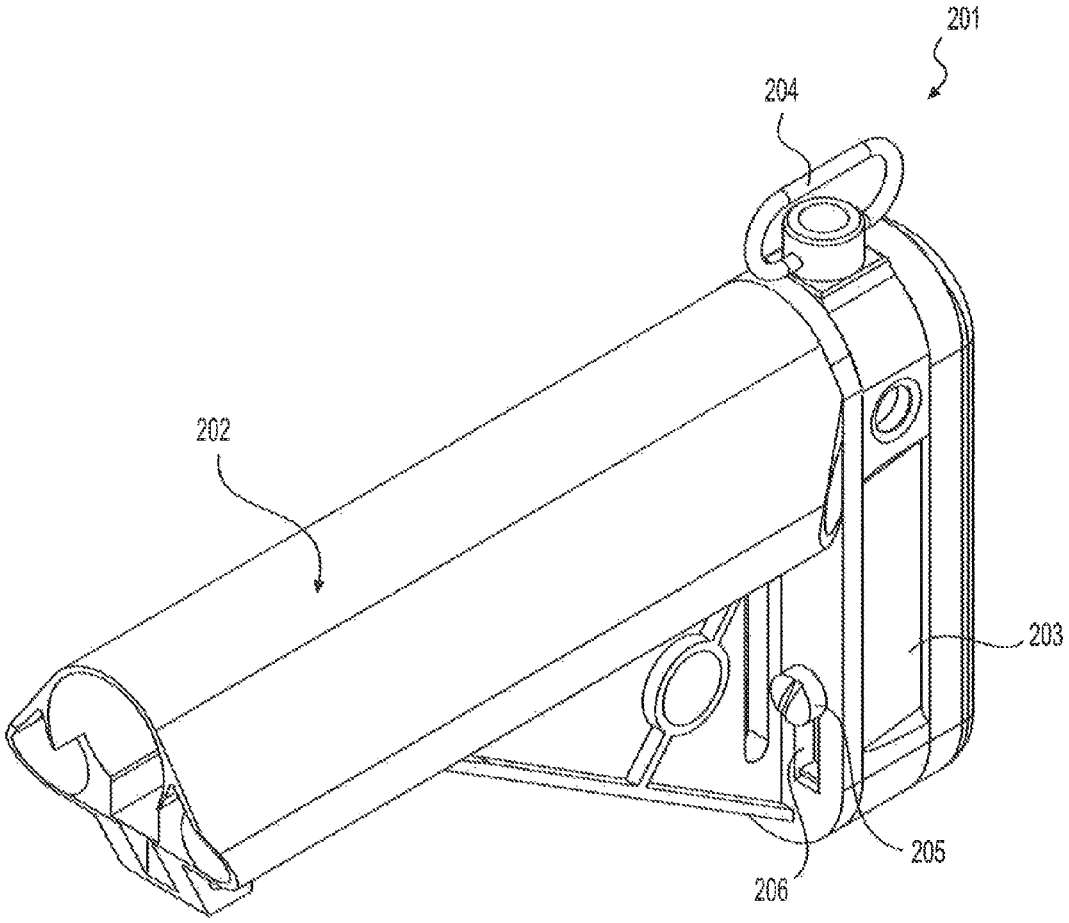
FIG. 2 is an illustration of an embodiment of an adjustable firearm stock adapter assembly mated with a firearm stock.

The FC LMT SOPMOD Butt Stock Adapter Kit (FC Adapter) is an embodiment of an adjustable firearm stock adapter assembly. FIG. 2 shows an isometric view of the FC Adapter 201 mounted on stock 202. FC Adapter 201 includes adapter 203 mounted to stock 203 through a hook (not shown) and screw 205 through pre-existing slot 206, and includes sling hook 204. The FC Adapter is specifically designed to mate with the LMT SOPMOD Stock for a Mil-Spec M-4 receiver. It should be appreciated that other embodiments may be configured for readily mounting to other stocks. The embodiments in the following description focus on the FC Adapter embodiment, but it is not intended to limit the scope of this disclosure to the FC Adapter embodiment. FIG. 1 shows a breakdown of the components that comprise the FC Adapter, and FIGS. 2-10 are engineering drawings that show a variety of views of the FC Adapter embodiment. It should be understood that several features of the FC Adapter embodiment may be modified without departing from the invention.

The FC Adapter enhances the shooter's ability to adjust the firearm's stock to fit into the natural pocket of the shoulder for the individual shooter, thus improving safety, comfort, and skill. The natural pocket of the human shoulder is slightly angled and varies from person to person. The traditional firearm's butt stock is oriented vertically and is generally a common distance from butt stock pad to weapon sights. This forces each shooter, regardless of size, to try to conform to the weapon's design. This results in inaccurate, convoluted, and less safe shooting positions. The FC Adapter eliminates these issues by permitting the individual to adjust the weapon system—and in particular the position of the butt stock relative to the user's shoulder—to fit the individual's body type. The FC Adapter also allows a user to adjust the weapon system to accommodate clothing, protective armament, equipment, and the like. Often, the shooter must wear protective vests, helmets, eyewear, or have miscellaneous backpacks that can interfere with the user's ability to position the firearm properly. The FC Adapter allows the shooter to make vertical and angular adjustments to a butt pad, to accommodate a variety of equipment configurations worn in various environments. This enables the shooter to be a more accurate, consistent, and safe firearm user.

The FC adapter features a quick, one-handed adjustment for left or right-handed shooters. To adjust the FC Adapter as shown in FIG. 1, the shooter pulls the butt plate 103 to the rear (right of the drawing), overcoming spring tension from collar 107 and tension spring 106, and rotate the butt plate 103 (and, if attached butt pad 102) left or right depending on the individual's preference. In the embodiment shown in the drawings, the user may rotate the Butt plate 103 a full 360 degrees in 22.5 degree increments, and adjusted vertically 1.85 inches in $5/16^{th}$ inch increments to adjust for cheek weld height relative to the remainder of the firearm and stock. It should be appreciated that the angular increments may be a design preference. For instance, an adapter may feature smaller angular increments (i.e., more positions), and/or may permit a larger potential vertical displacement.

Pulling the butt plate 103 away from the firearm to overcome the spring tension places the adapter assembly 100 into an unmated position. When the butt plate 103 is in the unmated position, splines located in the serrated plate 104 disengage from the female grooves in the adapter 105. It should be appreciated that the spline and groove locations may be reversed in some embodiments, and intermixed (e.g., splines and grooves on both the serrated plate and adapter) in other embodiments. In the embodiment shown, serrated plate 104 includes four splines, but more or less splines may be used. After a user rotates the unmated butt plate 103 into the desired location, the user may release pressure from the butt plate 103, and allow the spring tension from spring 106 to pull the butt plate 103 into a mated position with adapter 105. Through spring tension the serrated plate's splines and cut outs will reengage into the adapter 105 grooves, thereby locking the butt plate 103 into the desired position. It should be appreciated that the relative location of splines and grooves may vary from the FC Adapter embodiment.

Additionally, a user may adjust the vertical displacement of the butt plate 103 relative to the remainder of the firearm by loosening the engagement mechanism 108, which may be, for example, a screw or bolt that attaches the butt plate 103 to the adapter 105. Although the FC Adapter embodiment is shown as featuring a screw, other embodiments may rely on other engagement mechanisms for providing a releasable tension to secure the Butt plate 103 to the adapter 105. Simple devices such as screws and bolts may be advantageous because they are relatively cheap to manufacture, provide for a secure locked position, and require basic and common tools to operate (e.g., a flathead screwdriver or torque wrench). However, other means may be used to apply a removable tension to the butt plate 103 and adapter 105. Other embodiments may feature a spring-loaded button which the user may depress to release tension and adjust the butt plate 103. Other embodiments may feature a slidable switch that releases the tension and allows the butt plate 103 to freely travel along path to adjust the vertical displacement.

A user may move the butt plate 103 up or down incrementally when the tension is released (or reduced), and then fixed in place reapplying tension, such as by tightening the engagement mechanism 108 once the desired vertical position relative to the firearm or adapter 105 is reached. As can be seen in the drawings, in the FC Adapter embodiment, male and female serrations engage the serrated plate 104 to the butt plate 103 for a positive retention in the desired position. The relative positions of the serrations may be reversed in other embodiments, and may be intermixed in other embodiments. The serrations may take any shape suitable to create a seam of engagement between the butt plate 103 and serrated plate 104, sufficient to provide a tight fit in the tensioned position. The FC Adapter features a vertical slot through which the screw assembly travels for vertical adjustment. Alternatively, an adapter may feature corresponding counter wheels on each of the butt plate 103 and serrated plate 104 that allow those components to move relative to each other in the untensioned position. Other embodiments may feature other means for allowing the butt plate 103 and serrated plate 104 to move relative to each other in the untensioned position.

The FC Adapter may also feature a replaceable rubber butt pad 102 that reduces recoil and provides a non-slip surface allows for quicker and more accurate follow-up shots. The butt pad 102 may take a variety of shapes and sizes.

Embodiments may feature one or more quick disconnect attachments. For example, the FC Adaptor has 3 quick disconnect (QD) attachment locations near the top of the Adapter 105. The positioning of the QD receptacles provides a left or right handed shooter improved sling placement for the weapon, thereby improving weapon positioning and placement retention. Other embodiments may feature QD receptacles at other locations, as desired.

The FC Adapter features a hook and guide holes for connecting to the LMT SOPMOD Stock. Attachment of the FC Adapter to the LMT Butt Stock may be accomplished by the following method:

1. Remove the butt pad that comes standard on the LMT Butt Stock.
2. Position the hook on the Adapter 105, in the square cut out of the LMT Butt Stock
3. Slide the Adapter 105 vertically approximately ⅛ inch matching the profile of the Adapter 105 to the profile of the LMT Butt Stock.
4. Secure the bottom of the Adapter 105 to the LMT butt stock with two Screws (1) and tighten hand tight.
5. The addition of one drop of medium strength thread locker (blue number 243) per screw will increase security of the FC Adapter while allowing for future replacement.

It should be appreciated that the foregoing method is designed for the FC Adapter embodiment shown in the drawings. Depending on the particular method used to apply tension to the adapter 105 and butt stock 103, it may be appropriate to alter the steps. Other embodiments designed for use with different stocks may feature other structure for connecting the adapter assembly to the stock.

The FC Adapter is comprised of nine components. Screw: 1 screw attaches the butt plate, serrated plate, and collar together, and 2 screws attach the adapter assembly 100 to the LMT Butt Stock. Of course, other embodiments may use different engagement mechanisms, such as bolts, tension springs, and the like.

- Butt Pad: This portion is adhered to the Butt Plate and is made from a rubberized material, which provides a non-slip surface that reduces recoil which will allow for a quicker and more accurate follow up shot.
- Butt Plate: Attaches to the Serrated Plate and has a slot machined into it for vertical movement to raise and lower user preference and varying optic height. There are serrations machined into the back portion of the Butt Plate to engage the Senate Plate for increased stability.
- Serrated Plate: There are four splines machined into it at different locations to engage the twelve female grooves in the Adapter. There are serrations cut into the back portion of the Serrated Plate to engage the Butt Plate for increased stability.
- Adapter: There are twelve female grooves in 360 degrees. There are two holes threaded ¼-28 for attachment to the LMT Butt Stock. There are three quick disconnect sling attachments threaded into the Adapter. There is a hook portion that inserts into the LMT Butt Stock to aid in attaching the Adapter to the LMT Butt Stock.
- Compression Spring: The spring is installed over the collar to provide tension to the assembly and maintain a positive engagement of the Butt Plate. The constant spring force is a reasonable level that can be overcome by nominal hand pressure to enable Butt Plate adjustment.
- Collar: The Collar is threaded ¼-20 through its center so the Screw can attach the Butt Plate through the Adapter Plate.

Figure 3A:
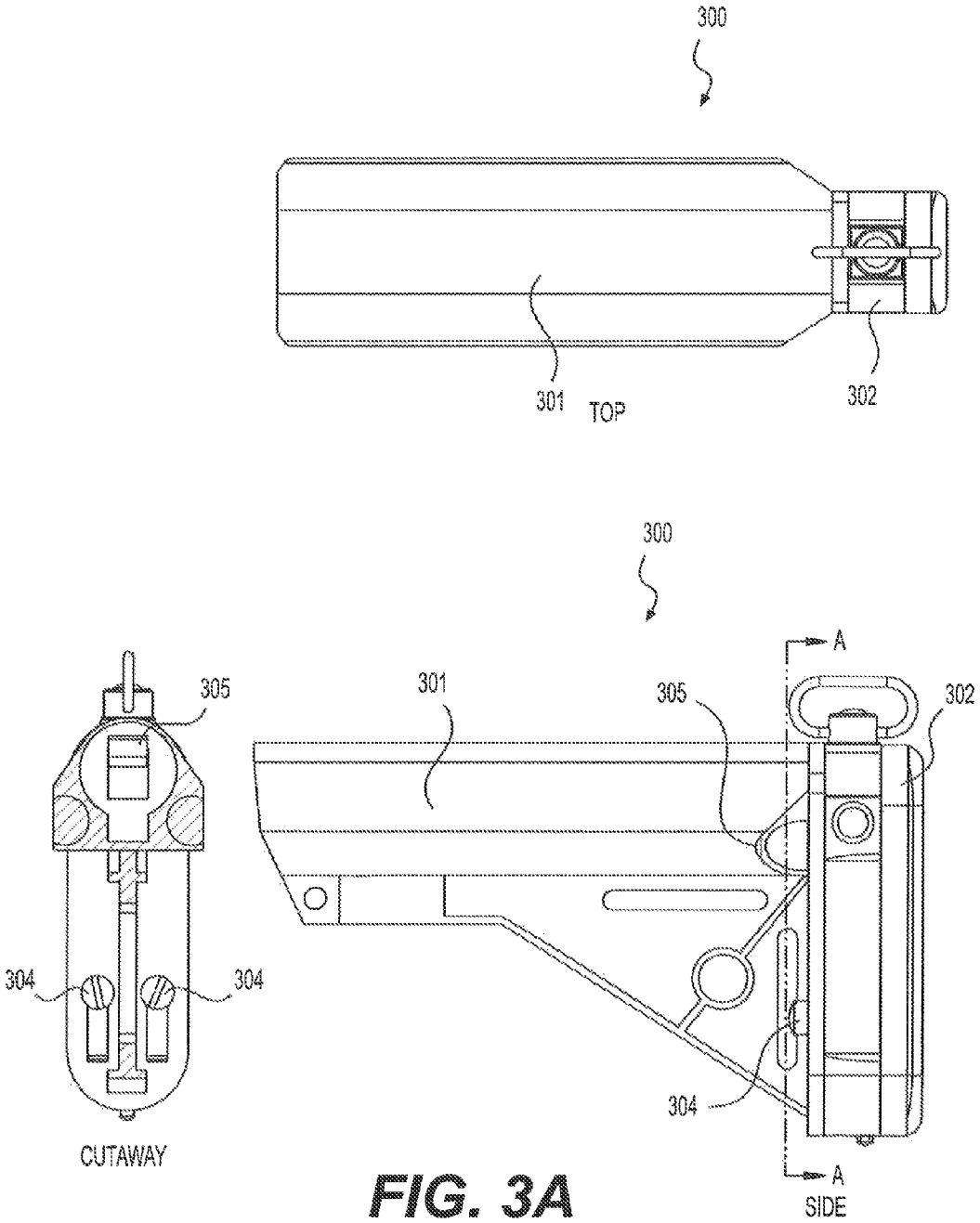
FIGS. 3A and 3B show multiple views of an embodiment of an adjustable firearm stock adapter assembly mated with a firearm stock.
Figure 3B:
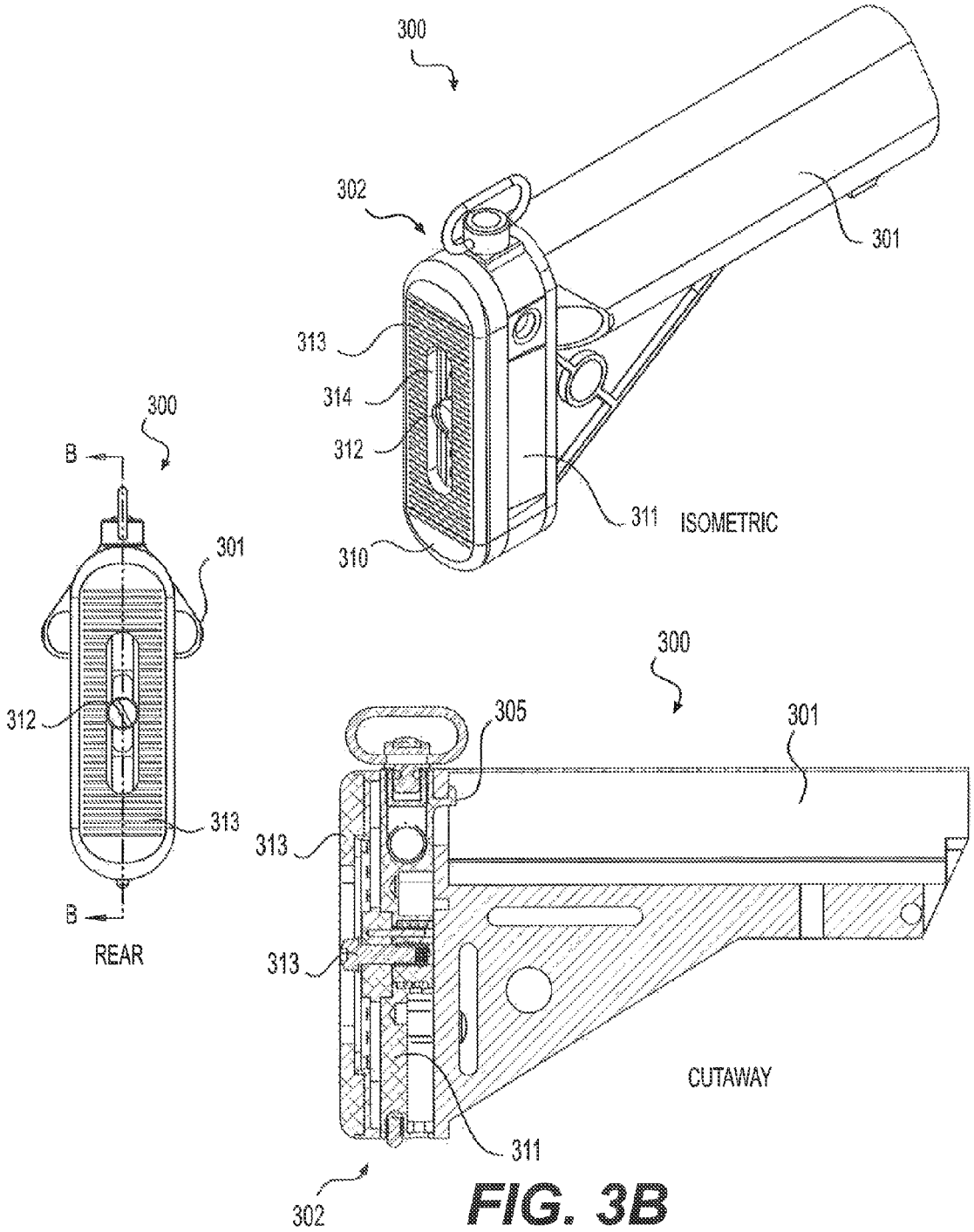

FIGS. 3A and 3B show multiple views of an embodiment of an adjustable firearm stock adapter assembly 300 mated with a firearm stock 301. Adapter assembly 300 includes an adapter 302 mounted to stock 301 by hook 305 and one or more engagement mechanisms 304. The cutaway views at Section A-A and Section B-B show hook 305 engaged to a corresponding slot in stock 301. Embodiments designed for other stocks may include one or more hooks or screws at other locations, as may be required for mounting to the stock. FIG. 3B shows adapter assembly 300 including butt pad 310 connected to butt plate and adapter 311 through engagement mechanism 312. As can be seen, engagement mechanism 312 (in this embodiment, a screw), extends through a vertical slot 314 in the butt plate, through serrated plate (not shown), and into a collar (not shown) mounted within adapter 302. Butt pad 310 includes a corrugated surface 313 to provide friction.

The FC Adapter may be finished with a Type II black anodized finish that provides protection against wear and corrosion.

An adapter assembly may further comprise a glass breaker formed on or built into an external surface. The FC Adapter features a cylindrical cutout portion in the toe area of the adapter 105 for receiving a glass breaker. In this embodiment, the glass breaker comprises a cylindrical body of a hardened material configured to snap or screw into the cylindrical cutout portion. The functional end of the glass breaker is shaped into a tip, which focuses impact force on a pinpoint location for shattering glass. The opposite end of the glass breaker may be threaded for screwing into the cutout portion, or may feature structure such as an annular lip configured to enable the glass breaker to snap into the cutout portion. Other embodiments may include a glass breaker having a different shape, size, or configuration. Locating the glass breaker along a toe surface of the adapter assembly allows a user to apply the glass breaker in a convenient manner and with a maximum amount of force. However, other embodiments may feature a glass breaker at other locations, such as the heel of the stock, and yet other embodiments may feature more than one glass breaker.

Figure 4A:
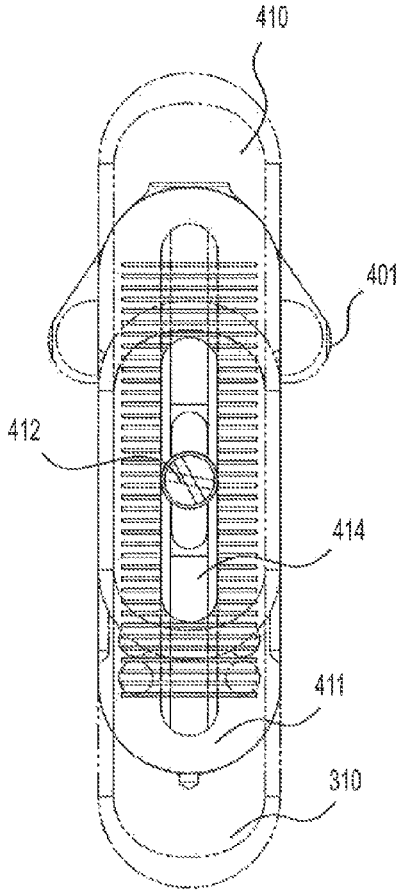
FIG. 4 illustrates demonstrative vertical and rotational adjustments made to an embodiment of an adjustable firearm stock adapter assembly.
Figure 4B:
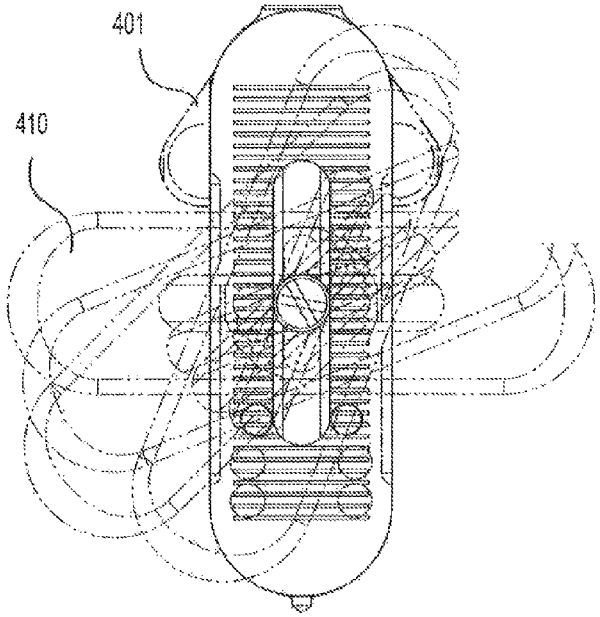

FIGS. 4A and 4B demonstrate the various positional relationships of an embodiment of the adjustable butt stock adapter assembly mounted on stock 401. FIG. 4A shows the adjustable vertical relationship between butt plate 410 and serrated plate 414 (and thus adapter, not visible in this view). Upon disengagement of engagement mechanism 412, butt plate 410 may be adjusted vertically with respect to serrated plate 414. The serrations on serrated plate 414 may interlock with serrations on butt plate 410, to allow for establishing a desired vertical relationship. FIG. 4B shows the rotational relationship between adapter (not visible in this view) and serrated plate 414 (and thus butt plate 410). Upon overcoming spring tension from the collar and spring (not shown), such as by pulling butt plate 410 away from the stock 401, butt plate 410 may be rotated to establish a rotational relationship relative to the adapter. The splines on the serrated plate may interlock with grooves on the adapter to establish a desired rotational relationship.

Figure 5:
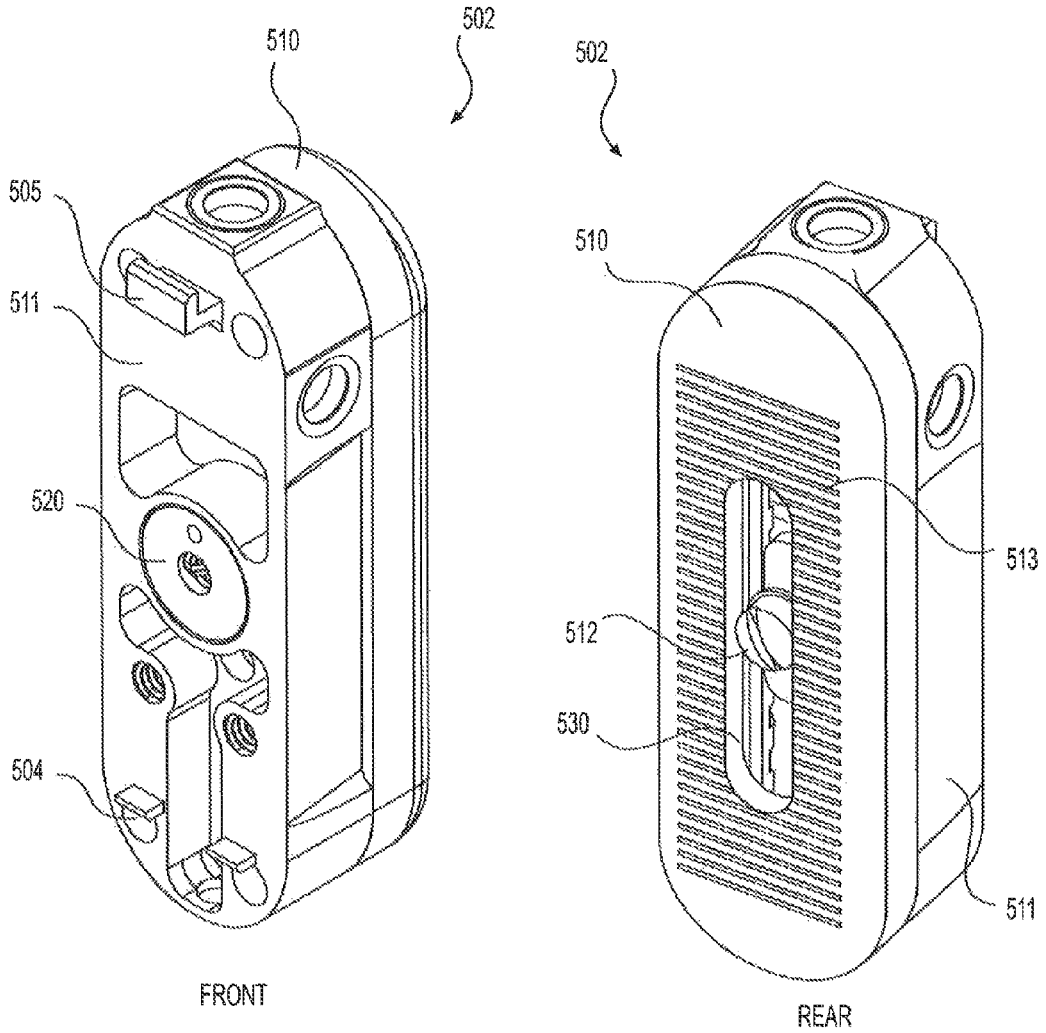
FIG. 5 shows an embodiment of a fully assembled adjustable firearm stock adapter assembly.

FIG. 5 shows a front and rear view of an embodiment of an adjustable butt stock adapter assembly 502. Adapter 511 has a first surface with attachment mechanisms for attaching to a stock (not shown), including hook 505 and bosses 505. The first surface also includes space for mounting collar 520. Butt plate 510 including vertical slot 530 is operatively connected to adapter 511 through engagement mechanism 512. In this manner, adapter 511 is adjustably coupled to the serrated plate (not shown), and the serrated plate is adjustably coupled to the butt plate 511.

Figure 6A:
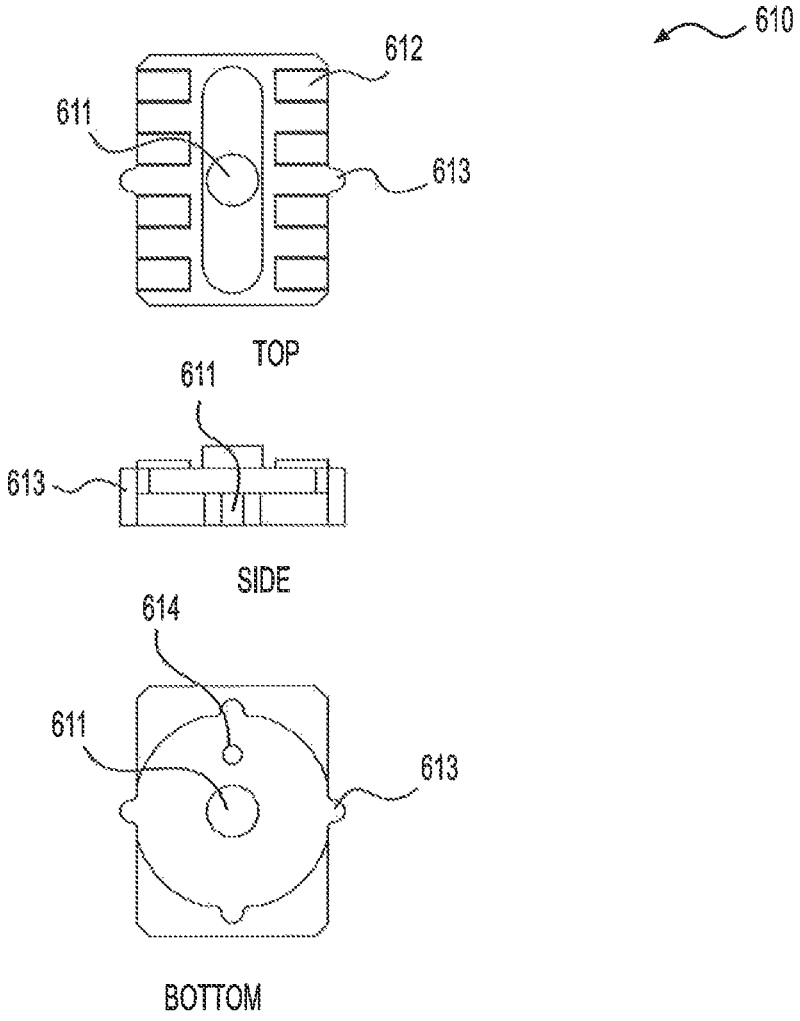
FIGS. 6A-6D show various views of components of an adjustable butt stock adapter assembly.

FIGS. 6A-6D show various views of components of an adjustable butt stock adapter assembly. FIG. 6A shows top, bottom, and side views of an embodiment of a serrated plate 610. Serrated plate 610 includes a plurality of splines 613, configured for adjustable engagement with a plurality of grooves in an adapter to establish a rotational relationship between the adapter and the serrated plate. In this embodiment, serrated plate 610 includes four splines 613 arranged circumferentially. The adapter grooves may be arranged circumferentially, and provide for numerous rotational relationships for mating the serrated plate's splines 613.

Serrated plate 610 includes a plurality of serrations 612, configured for adjustable engagement with corresponding serrations in a butt plate to establish a vertical relationship between the serrated plate and the butt plate. As shown in FIG. 6A, serrations 612 are formed on a surface of serrated plate 610 that may be placed in contact with a butt plate. Serrations 612 fit into corresponding serrations in the butt plate. However, the butt plate includes more serrations in a vertical alignment, such that the serrated plate serrations 612 may be positioned at a number of vertical relationships with the butt plate. Serrated plate 610 may also include a through hole 611, through which an engagement mechanism may mount. In some embodiments, serrated plate includes a protruding member 615, which may through (partially or fully) a vertical slot in the butt plate. The serrated plate's serrations 612 may be disengaged from the butt plate's vertically aligned serrations and adjusted, and the protruding member 615 may maintain alignment during adjustment. Protruding member 615 may also be used in connection with an engagement mechanism to maintain connection between serrated plate 610 and the butt plate.

Figure 6B:
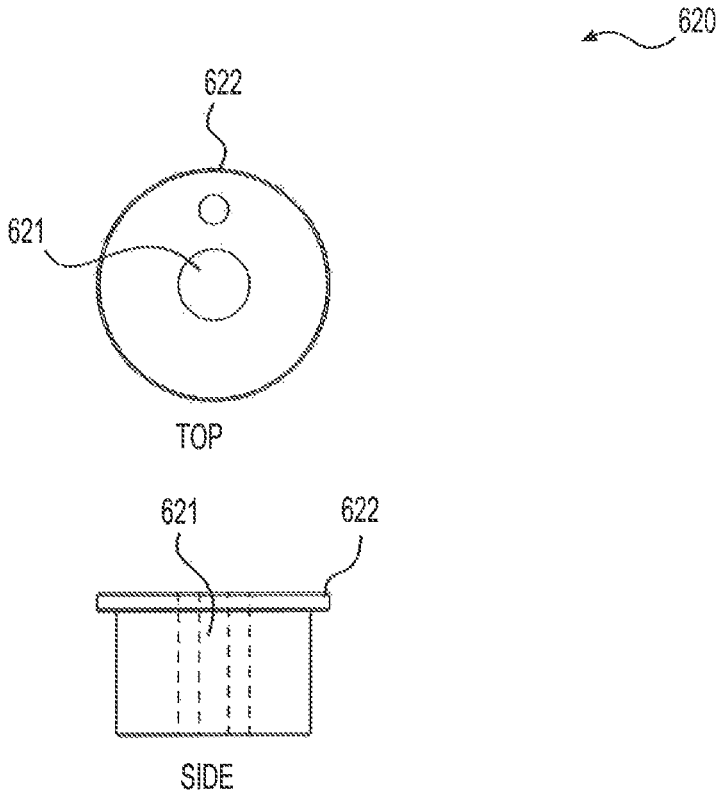

FIG. 6B shows top and side views of collar 620. In this embodiment, collar 620 is round, though the collar shape may vary. A spring may be mounted in the collar 620, or alternatively around an extending portion of the collar 620, to provide a spring force that biases the collar 620 outward toward the first surface. In this configuration, the serrated plate may be pulled away from the second surface to overcome the spring force and allow adjustment of the rotational relationship between the adapter and the serrated plate. In this embodiment, collar 620 includes an annular lip 622 for engagement with a stock-side surface of the adapter, and may engage a detent member. Collar 620 may include a through hole 621 for receiving an engagement mechanism.

Figure 6C:
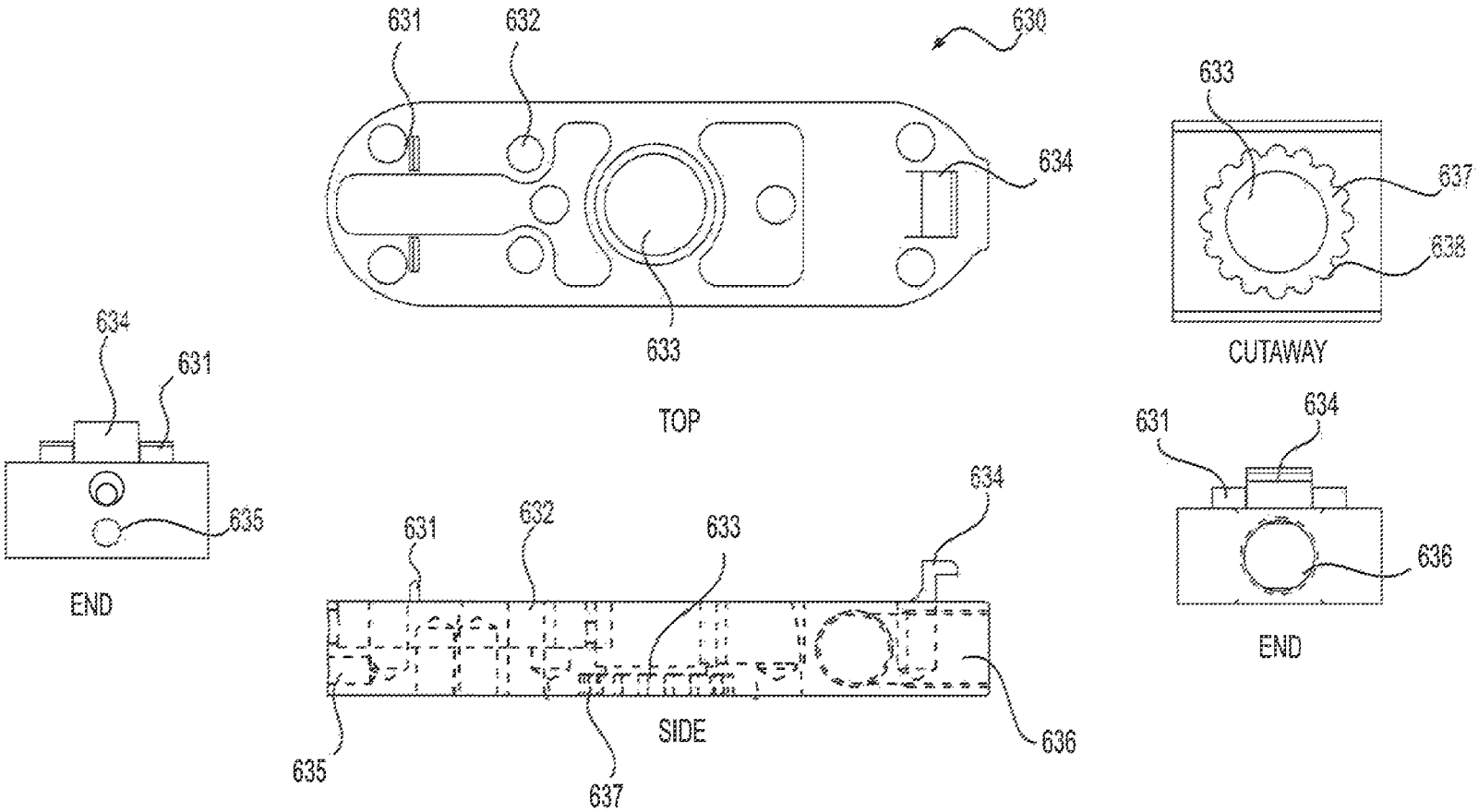

FIG. 6C shows top, end, side, and cutaway views an embodiment of adapter 630. The top of adapter 620 is configured for contacting a stock, and may include a hook 634, one or more engagement mechanism holes 632, and one or more bosses 631. Adapter 620 also includes a slot 633 for receiving a collar. One end of the adapter 620 may include a port 635 for receiving a glass breaker, as described above. Adapter 630 includes another surface for contacting a serrated plate and a butt plate. This surface is configured for operative engagement with the butt plate, and includes a plurality of grooves 637. Grooves 637 are configured for engagement with splines in a serrated plate in this embodiment, although those components may be rearranged or intermixed. As shown in cutaway at Section A-A, grooves 637 in this embodiment are arranged in a circular configuration to provide more than one rotational relationships between the adapter 630 and serrated plate, and may be, for example, gear-shaped 638.

Figure 6D:
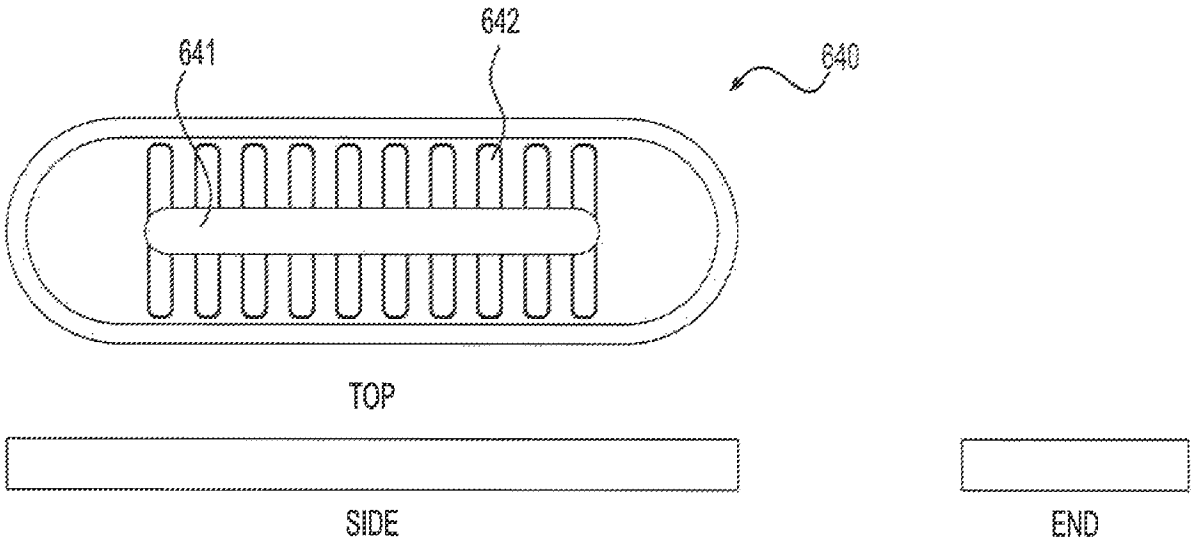

FIG. 6D shows top, side, and end views of a butt plate 640. In this embodiment, butt plate 640 includes vertically aligned serrations 642 aligned along vertical slot 641. As discussed above, the vertically aligned serrations 642 provide for a plurality of vertical relationships between the serrated plate and the butt plate 640. The spacing and orientation of the serrations may be different in other embodiments. Some embodiments may feature more than one vertical slot, e.g., for embodiments in which the serrated plate is configured to engage more than one set of corresponding serrations.

Figure 7:
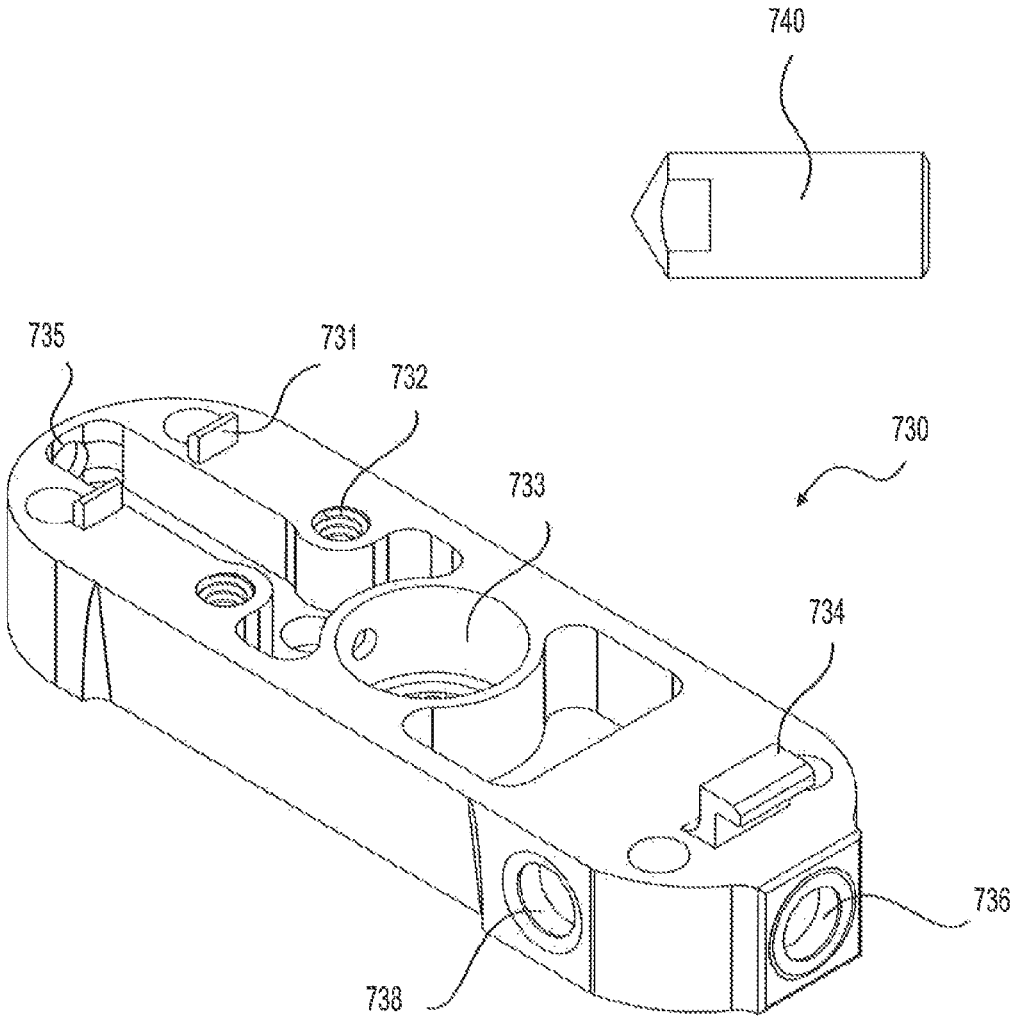
FIG. 7 shows an isometric view of embodiments of an adapter and an optional glass breaker.

FIG. 7 shows an isometric view of an embodiment of adapter 730, and an optional glass breaker 740. In this embodiment, adapter 730 includes a slot 735 for receiving glass breaker 740. Glass breaker 740 may be configured for one or more forms of engagement in slot 735, including, for example, a threaded relationship, form fitting, snap-tight, and the like. Adapter 730 also has a ring 736 for receiving a strap hook, side rings 738 for connection to auxiliary devices, slot 730 for receiving a collar as described above, holes 732 for receiving engagement mechanisms (e.g., screws, bolts, and the like), hook 734 and bosses 731 for connecting to a stock. It should be appreciated that other embodiments of an adapter may feature different configurations and components.

Figure 8A:
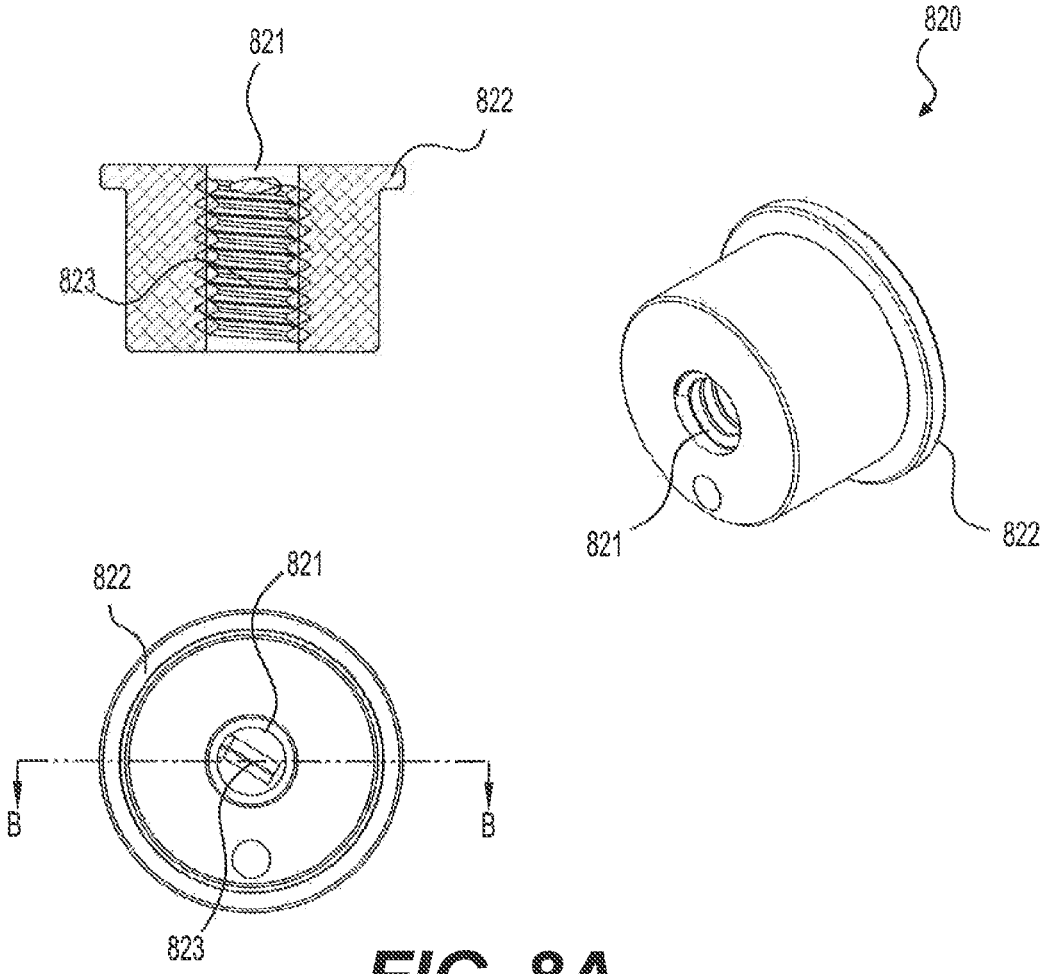
FIGS. 8A and 8B show various views of embodiments of a collar and serrated plate.
Figure 8B:
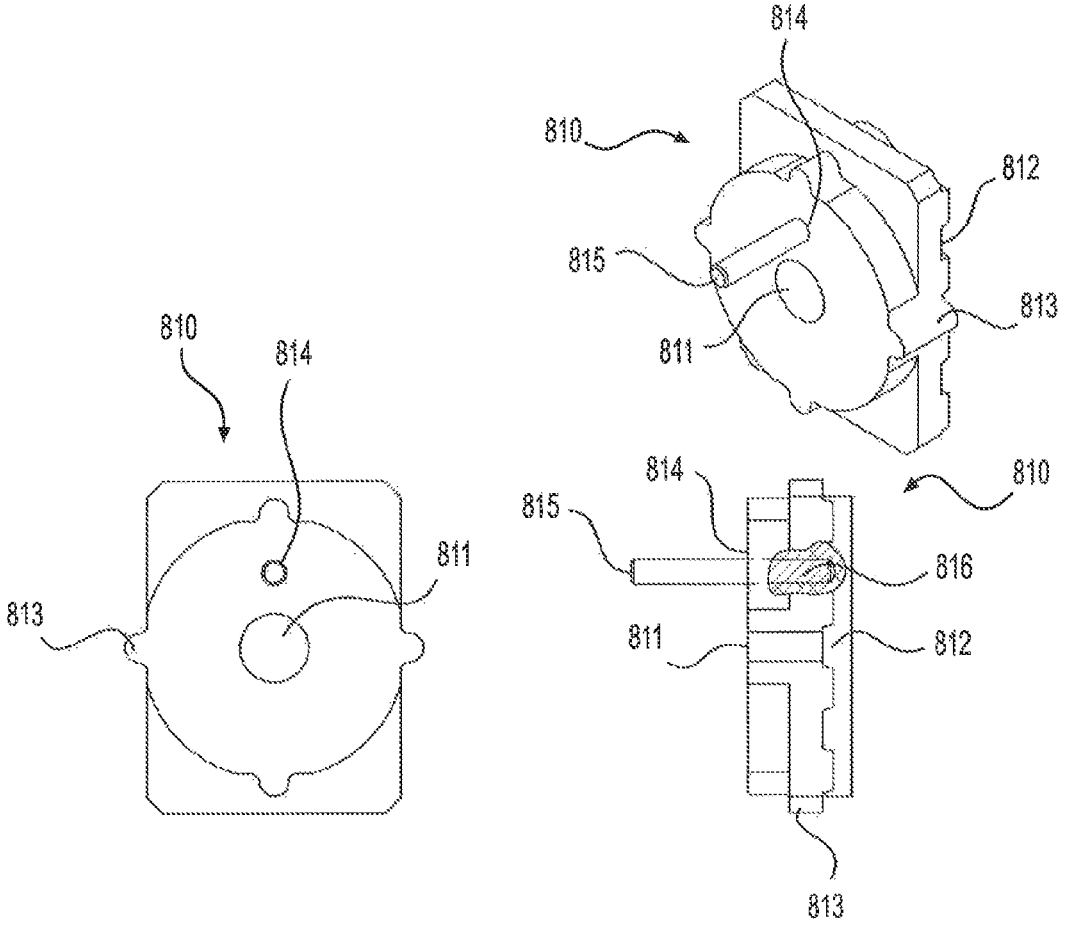

FIGS. 8A and 8B show additional views of embodiments of collar 820 and serrated plate 810. As shown in FIG. 8A, this embodiment of collar 820 includes an annular lip 822 configured to engage a surface of an adapter to maintain the collar 820 position when mounted to an adapter. As shown in cutaway at Section B-B, collar 820 also includes a central hole 821 that may be used to house threaded surface 823, which may be, for example, Heli-coil, to provide for engagement to an engagement mechanism 108 such as a screw or a bolt. An engagement mechanism may connect various components of the assembly, such as, for example, a butt pad, a butt plate, a serrated plate, and an adapter, to the collar 820. In some embodiments, a spring (not shown) may be coiled around the collar 820 to provide spring force as discussed herein. For example, a spring may be connected to a serrated plate, such that the spring force biases the serrated plate toward the engaged position. As described above, a user may disengage the serrated plate (and butt plate) by pulling the serrated plate and butt plate away from the collar, and may then adjust the rotational position. The spring will reengage serrated plate to collar when a user releases the serrated plate.

FIG. 8B shows other views of an embodiment of serrated plate 810, which includes a plurality of serrations 812, and a plurality of splines 813. As can be seen, serrations 812 may be on a side of the serrated plate 810 configured for contacting a butt plate (not shown), such that serrations 812 may engage corresponding serrations on the butt plate and establish a vertical relationship. The serrations shown in this embodiment are a series of indentations that may mesh with corresponding protrusions in a butt plate. However, one of skill in the art should appreciate that the serrations in the serrated plate and corresponding serrations in the butt plate may comprise any form of surface protrusions and depressions configured to mate in one or more desired positions, such that the mating results in a vertical relationship. The scope of this disclosure is not intended to be limited to the type, shape, or configuration of serrations. Through hole 811 may house an engagement mechanism, such as a screw or a bolt, to operatively connect serrated plate 810 to the collar. Serrated plate 810 may also include a dowel 815 engaged in slot 816. Dowel 815 may insert into a corresponding slow in collar 820, such that collar 820 and serrated plate 810 maintain a relative position even during changes in the rotational relationship between serrated plate 810 and an adapter. For example, the collar 820 may rotate with the serrated plate 810 during changes in the rotational relationship between serrated plate 810 and an adapter.

FIG. 8B also shows a plurality of splines 813 protruding from sidewalls of the serrated plate 810. As discussed above, the splines 813 are configured for adjustable engagement with an adapter's plurality of grooves to establish a rotational relationship between the adapter and the serrated plate. In this way, serrated plate 810 may be rotated relative to the adapter, and once the desired rotational relationship is achieved, the splines 813 may engage the corresponding grooves. The splines 813 shown in this embodiment are a series of protrusions protruding radially from the serrated plate sidewalls, and are configured for meshing with a gear shaped series of grooves in an adapter. The number and arrangement of the grooves determines the different rotational relationships that may be achieved, as discussed above. However, one of skill in the art should appreciate that the splines and corresponding grooves in the adapter may comprise any form of surface protrusions and depressions configured to mate in one or more desired positions, such that the mating results in a rotational relationship. For example, holes and pages, bumps and divots, and other protrusions and depressions may be used as splines and grooves, without departing from the scope of this disclosure. The scope of this disclosure is not intended to be limited to the type, shape, or configuration of splines and grooves. Similarly, the location of serrations, splines, and grooves may vary from what is shown in the exemplar embodiments, such that, for example, the positions are reversed (e.g., grooves on the serrated plate and splines on the adapter), or intermixed (e.g., grooves and splines on both the serrated plate and adapter).

Figure 9A:
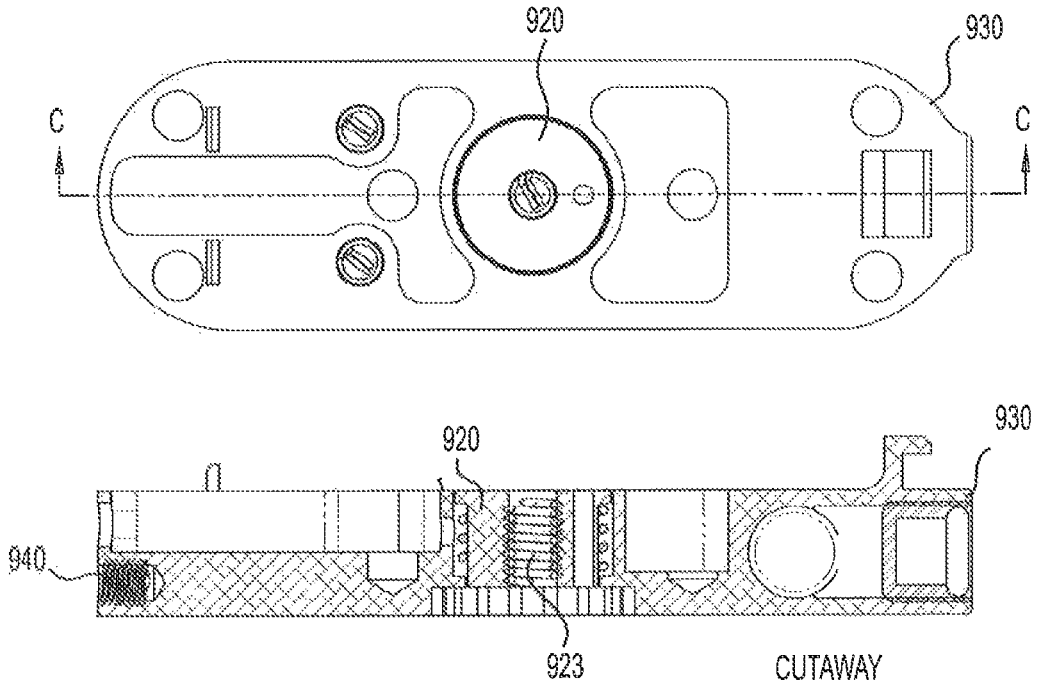
FIGS. 9A-9C illustrate various assembled components of an embodiment of an adapter assembly.
Figure 9B:
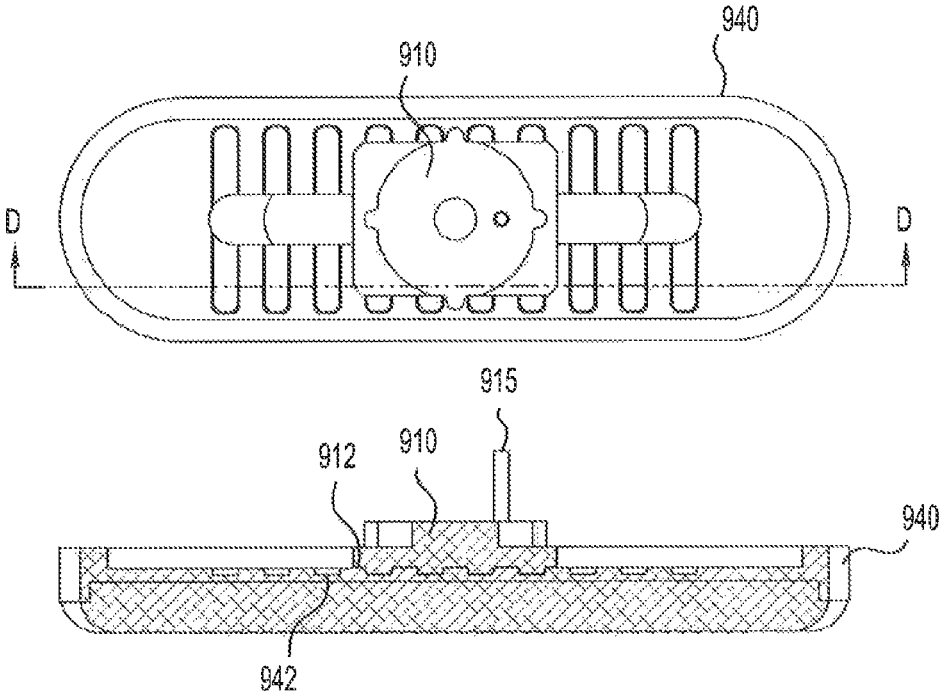
Figure 9C:
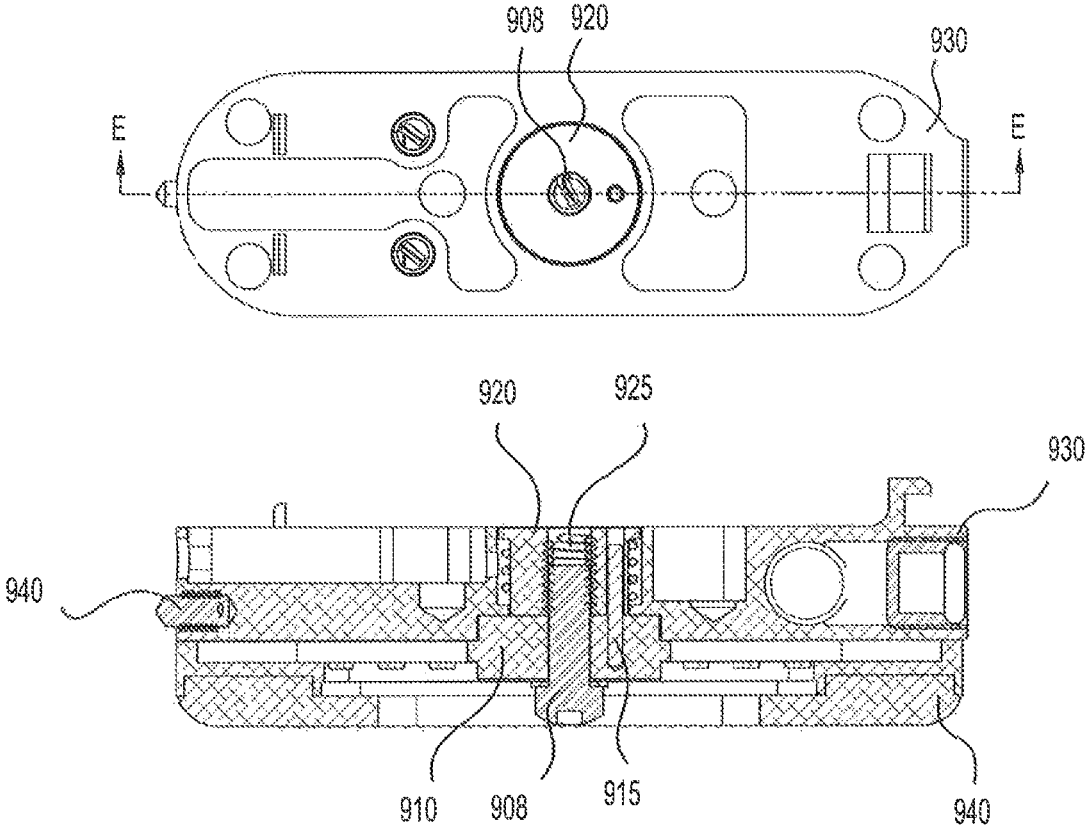

FIGS. 9A-9C illustrate various assembled components of an embodiment of an adapter assembly. FIG. 9A shows a top view of an adapter 930 with collar 920 and spring 923 mounted therein. The cutaway view at Section C-C shows the position of collar 920 and spring 923 mounted in the adapter 930 in this embodiment. Adapter 930 also includes slot 935 for receiving a glass breaker.

FIG. 9B shows butt plate 940 in a vertical relationship with serrated plate 910. Cutaway view at Section DD shows serrated plate 910 serrations 912 engaged with a portion of the butt plate's serrations 942. The engagement between serrations 912 and 942 establishes a vertical relationship between serrated plate 910 and butt plate 940. In this embodiment, the position of serrated plate 910 may be adjusted vertically (i.e., left or right in this drawing), by disengaging serrations 912 and serrations 942, adjusting the position, and reengaging serrations 912 and serrations 942 at the new position.

FIG. 9C shows an adapter assembly having adapter 930, collar 920, spring 923, butt plate 940, and serrated plate 910. Collar 920 and spring 923 are mounted in adapter 930. Serrated plate 910 is positioned between the adapter 930 and a portion of the butt plate 940. Engagement mechanism 908 (in this embodiment a screw) connects to spring 923 through a slot in butt plate 940, a slot through serrated plate 910, a slot in adapter 930, and a slot in collar 920. Pulling butt plate 940 away from adapter 930 (in view drawing, downward) with enough force to overcome spring force from spring 923 disengages serrated plate 910 from the adapter 930, allowing for adjustment of the rotational relationship between serrated plate 910 (and thus butt plate 940) and the adapter 930. Loosening engagement mechanism 908 allows for adjustment of the vertical relationship between serrated plate 910 (and thus the adapter 930) and butt plate 940. In this embodiment, serrated plate 910 includes connection mechanism 915 (in this case, a cylindrical dowel), connecting serrated plate 910 to collar 920, such that serrated plate 910 and collar 920 may rotate together during adjustments in the rotational relationship between serrated plate 910 and adapter 930. This embodiment also includes a glass breaker 935.

Figure 10:
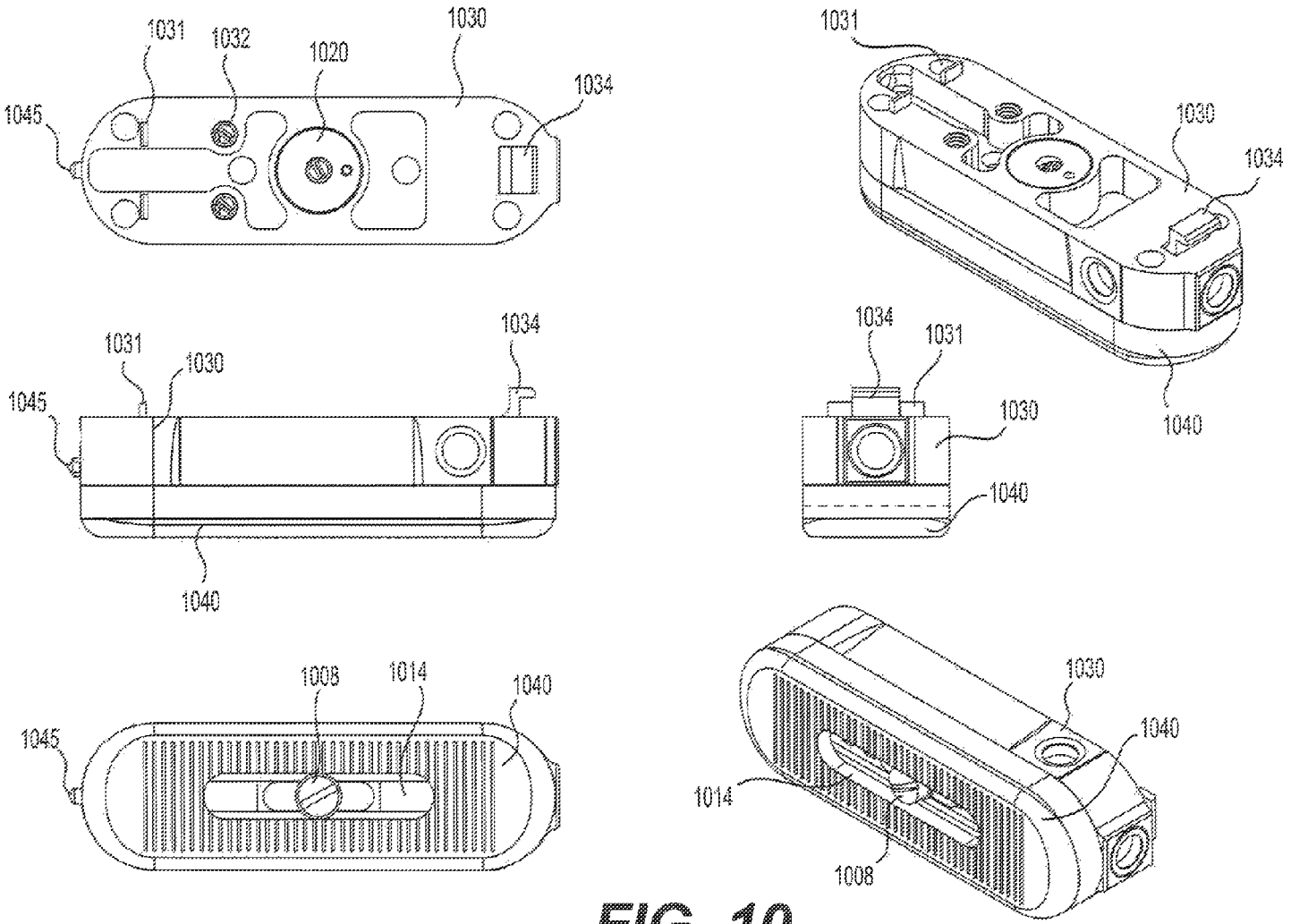
FIG. 10 shows various views of an embodiment of an adapter assembly.

FIG. 10 shows various views of a fully assembled embodiment of the adapter assembly. Adapter 1030 includes hook 1034 and bosses 1031 for connecting to a stock (not shown). Collar 1020 is mounted in adapter 1030 as described above. Glass breaker 1045 is inserted into adapter 1030. Butt plate 1040 (with a butt pad) is connected through engagement device 1008, through vertical slot 1014.

The terminology used herein is for the purpose of describing particular embodiments only and is not intended to be limiting of the approach. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. An adjustable butt stock adapter assembly comprising:

(a) a butt plate having a plurality of vertically aligned serrations;

(b) an adapter having (i) a first surface configured for connection to a stock, and (ii) a second surface for operative engagement with the butt plate and having a plurality of grooves;

(c) a serrated plate positioned between the second surface and a portion of the butt plate, the serrated plate having (i) a plurality of splines configured for adjustable engagement with the adapter's plurality of grooves to establish a rotational relationship between the adapter and the serrated plate, and (ii) a plurality of serrations configured for adjustable engagement with the butt plate's vertically aligned serrations to establish a vertical relationship between the serrated plate and the butt plate;

wherein the adapter is adjustably coupled to the serrated plate, and the serrated plate is adjustably coupled to the butt plate.

2. The adjustable butt stock adapter assembly of claim 1, further comprising a collar mounted within the adapter, the collar having an annular lip for engagement with the first surface of the adapter and an extending portion extending into the adapter toward the second surface, wherein the collar operatively couples the adapter to the serrated plate.

3. The adjustable butt stock adapter assembly of claim 2, wherein the collar further comprises a spring providing a spring force to bias the serrated plate toward the collar, such that the serrated plate may be pulled away from the collar to overcome the spring force and allow adjustment of the rotational relationship between the adapter and the serrated plate.

4. The adjustable butt stock adapter assembly of claim 3, wherein the adapter's plurality of grooves are circularly arranged about a focal point, and the serrated plate's plurality of splines are arranged in a corresponding circular arrangement.

5. The adjustable butt stock adapter assembly of claim 3, wherein the butt plate further comprises a vertical slot, and the butt plate's vertically aligned serrations are aligned along the vertical slot.

6. The adjustable butt stock adapter assembly of claim 5, wherein the serrated plate comprises a protruding member configured to protrude through the butt plate's vertical slot, such that the serrated plate's plurality of serrations may be disengaged from the butt plate's vertically aligned serrations to allow adjustment of the vertical relationship between the serrated plate and the butt plate.

7. The adjustable butt stock adapter assembly of claim 6, further comprising an engagement mechanism releasably coupling the serrated plate to the butt plate.

8. The adjustable butt stock adapter assembly of claim 7, wherein the engagement mechanism extends through the butt stock's vertical slot.

9. The adjustable butt stock adapter assembly of claim 8, wherein the engagement mechanism comprises one of a screw, a spring, and a bolt.

10. The adjustable butt stock adapter assembly of claim 1, wherein the first surface of the adapter further comprises a hook for engagement with a stock.

11. The adjustable butt stock adapter assembly of claim 10, wherein the first surface of the adapter further comprises at least one boss for cooperative engagement with the stock.

12. The adjustable butt stock adapter assembly of claim 1, wherein the butt plate further comprises a vertical slot, and the butt plate's vertically aligned serrations are aligned along the vertical slot.

13. The adjustable butt stock adapter assembly of claim 12, wherein the serrated plate comprises a protruding member configured to protrude through the butt plate's vertical slot, such that the serrated plate's plurality of serrations may be disengaged from the butt plate's vertically aligned serrations to allow adjustment of the vertical relationship between the serrated plate and the butt plate.

14. An adjustable butt stock adapter assembly comprising:

(a) a butt plate having a plurality of vertically aligned serrations;

(b) an adapter having (i) a first surface configured for connection to a stock, and (ii) a second surface for operative engagement with the butt plate and having a plurality of grooves;

(c) a collar mounted within the adapter, the collar having an annular lip for engagement with the first surface of the adapter and an extending portion extending into the adapter toward the second surface;

(d) a serrated plate positioned between the second surface and a portion of the butt plate and operatively coupled to the collar's extending portion, the serrated plate having (i) a plurality of splines configured for adjustable engagement with the adapter's plurality of grooves to establish a rotational relationship between the adapter and the serrated plate, and (ii) a plurality of serrations configured for adjustable engagement with the butt plate's vertically aligned serrations to establish a vertical relationship between the serrated plate and the butt plate;

wherein the adapter is adjustably coupled to the serrated plate, and the serrated plate is adjustably coupled to the butt plate.

15. The adjustable butt stock adapter assembly of claim 14, wherein the collar further comprises a spring connected to the serrated plate and providing a spring force to bias the serrated plate toward the collar, such that the serrated plate may be pulled away from the collar to overcome the spring force and allow adjustment of the rotational relationship between the adapter and the serrated plate.

16. The adjustable butt stock adapter assembly of claim 15, wherein the butt plate further comprises a vertical slot, and the butt plate's vertically aligned serrations are aligned along the vertical slot.

17. The adjustable butt stock adapter assembly of claim 16, wherein the serrated plate comprises a protruding member configured to protrude through the butt plate's vertical slot, such that the serrated plate's plurality of serrations may be disengaged from the butt plate's vertically aligned serrations to allow adjustment of the vertical relationship between the serrated plate and the butt plate.

* * * * *